US008340559B2

(12) United States Patent
Kuroda et al.

(10) Patent No.: US 8,340,559 B2
(45) Date of Patent: Dec. 25, 2012

(54) FIXING DEVICE AND IMAGE FORMING APPARATUS

(75) Inventors: Masayoshi Kuroda, Toyokawa (JP); Tatsuyuki Sasaki, Toyokawa (JP); Takuya Wada, Shinshiro (JP); Haruki Iwatsuki, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 121 days.

(21) Appl. No.: 13/035,418

(22) Filed: Feb. 25, 2011

(65) Prior Publication Data

US 2011/0211878 A1 Sep. 1, 2011

(30) Foreign Application Priority Data

Feb. 26, 2010 (JP) ..... 2010-042057

(51) Int. Cl.
*G03G 15/20* (2006.01)
*G03G 15/00* (2006.01)

(52) U.S. Cl. ..... 399/322; 399/405

(58) Field of Classification Search ..... 399/322, 399/328, 400, 405, 406; 219/216
See application file for complete search history.

(56) References Cited

U.S. PATENT DOCUMENTS 6,671,490 B2 * 12/2003 Suenaga ..... 399/406
7,149,463 B2 * 12/2006 Fujisawa et al. ..... 399/323
7,299,000 B2 * 11/2007 Taira et al. ..... 399/322
2006/0092258 A1 5/2006 Taira et al.
2010/0135705 A1 * 6/2010 Lin et al. ..... 399/322

FOREIGN PATENT DOCUMENTS

JP 04322280 A * 11/1992
JP 07285721 A * 10/1995
JP 2003215953 A * 7/2003
JP 2006-133377 5/2006
JP 2007199255 A * 8/2007

* cited by examiner

*Primary Examiner* — Robert Beatty

(74) *Attorney, Agent, or Firm* — Buchanan Ingersoll & Rooney PC

(57) ABSTRACT

A fixing device comprises: a heating rotary member and a pressurizing rotary member, which form a nip, and guiding members for guiding a recording sheet that has passed through the nip. In a cross-section perpendicular to a rotation axis of the heating rotary member, La connects axial centers of two rotary members, Lb is perpendicular to La, P is on a guiding surface of one of the guiding members and horizontally closer to the pressurizing rotary member than any other points thereon, said one of the guiding members being closer to the heating rotary member than the other, Lc passes through P and is tangent to an outer circumference of the heating rotary member near the nip, and D is a P-La distance. Here, heating rotary member diameter×1.6≦D<heating rotary member diameter×2.4. Above the nip, Lc leans further toward the heating rotary member than Lb, and 2.2°≦angle between Lc and Lb<6.5°.

10 Claims, 7 Drawing Sheets

FIG. 4

| Angle ($\alpha$) / Distance (D) | $\alpha < 2.2°$ | $2.2° \leq \alpha < 6.5°$ | $\alpha \geq 6.5°$ |
|---|---|---|---|
| $D < 1.6d$ | Back curl | Wave | Wave and face curl |
| $1.6d \leq D < 2.4d$ | Back curl | None | Wave and face curl |
| $D \geq 2.4d$ | Back curl | Wave | Wave and face curl |

FIXING DEVICE AND IMAGE FORMING APPARATUS

This application is based on an application No. 2010-042057 filed in Japan, the contents of which are hereby incorporated by reference.

BACKGROUND OF THE INVENTION (1) Field of the Invention

The present invention relates to a fixing device having guide members that suppress a curl and a wave in a recording sheet, and to an image forming apparatus comprising the fixing device.

(2) Description of the Related Art

In recent years, the mainstream structure of image forming apparatuses that incorporate electrophotography is such that each apparatus has a compact body with a paper feed mouth, a transfer position and a fixing position arranged substantially on a straight line extending in the direction of the height of the apparatus, so as to minimize the length of the path along which paper feeding, transferring, fixing and paper discharge are performed.

However, image forming apparatuses with such a conveyance path extending in the direction of the height of the apparatuses (hereinafter also referred to as "image forming apparatuses for height-direction conveyance") have a problem that a recording sheet is easily curled or waved after passing through the fixing device (a wave in the recording sheet is a phenomenon in which there is a repetition of small curls in the recording sheet).

In general, immediately after the recording sheet passes through a fixing nip formed in the fixing device, the melted toner is not completely dried out, and moisture is evaporated from the recording sheet as a result of fixing by heat and pressure. This renders the recording sheet feeble and very soft. If the temperature of the recording sheet decreases thereafter, the shape of the recording sheet at that moment tends to remain.

Assume a case where the recording sheet is conveyed in a horizontal direction to pass through the fixing device and then is discharged in the horizontal direction. In this case, the recording sheet is in a stable posture after passing through the nip due to gravity; hence, the recording sheet is not easily curled or waved. On the other hand, in the above-described image forming apparatuses for height-direction conveyance, since the recording sheet is conveyed upward after passing through the fixing nip, the recording sheet is in an extremely unstable posture, and hence the curl/wave phenomena easily occur.

A curled or waved recording sheet has a very undesirable appearance. In addition, when a large number of recording sheets are discharged onto a discharge tray in a stack, curls or waves in the recording sheets make it difficult to line up the recording sheets. In the worst case, a curl or a wave in a recording sheet could cause a jam.

To address the above problems, fixing devices in conventional image forming apparatuses are structured as follows. As shown by a fixing device 500 of FIG. 7, a pair of intermediate rollers 504 is placed in a position that is between (i) a fixing nip formed by a heating roller 501 and a pressurizing roller 502 and (ii) a pair of discharge rollers 506, and that is close to the fixing nip. Immediately after the recording sheet passes through the fixing nip, the recording sheet is corrected in posture by the pair of intermediate rollers 504 applying suitable tension to the recording sheet. Thereafter, the recording sheet is conveyed to the pair of discharge rollers 506 along a conveyance path 505.

However, with the structure of the above-described conventional fixing devices, existence of the pair of intermediate rollers 504 is inevitable. Accordingly, a large number of components are required in the conventional fixing devices, and a cost increase is unavoidable. Such conventional fixing devices are against the idea of making image forming apparatuses compact.

SUMMARY OF THE INVENTION

The present invention has been conceived in light of the above problems.

A fixing device pertaining to one aspect of the present invention comprises: a heating rotary member; a pressurizing rotary member that forms a nip by coming in contact with the heating rotary member; and a pair of guiding members for guiding a recording sheet, which has been conveyed with a toner image formed on a surface thereof and which has passed through the nip, toward a direction along which the recording sheet is discharged. In this fixing device, in a cross-section perpendicular to a rotation axis of the heating rotary member, (i) La is a straight line connecting an axial center of the heating rotary member and an axial center of the pressurizing rotary member, (ii) Lb is a line perpendicular to the straight line La, (iii) P is a point that is on an outline of a guiding surface of one of the pair of guiding members and that is closer to the pressurizing rotary member than any other points on the outline in a direction parallel to the straight line La, said one of the pair of guiding members being positioned closer to the heating rotary member than the other, (iv) Lc is one of two tangent lines passing through the point P and tangent to an outline of an outer circumference of the heating rotary member, whose point of tangency is closer to the nip than a point of tangency of the other, and (v) D is a distance between the point P and the straight line La. Also, in this fixing device, (i) the distance D is larger than or equal to 1.6 times a diameter of the heating rotary member and is smaller than 2.4 times the diameter of the heating rotary member, and (ii) above the nip, the tangent line Lc leans further toward the heating rotary member than the perpendicular line Lb, and an angle formed by the tangent line Lc and the perpendicular line Lb is larger than or equal to 2.2° and is smaller than 6.5°.

Also, an image forming apparatus pertaining to another aspect of the present invention comprises: a toner image forming unit configured to form a toner image on a recording sheet; a fixing device configured to fix the toner image on the recording sheet; and a pair of guiding members for guiding the recording sheet which has passed through the fixing device and on which the toner image has been fixed, toward a direction along which the recording sheet is discharged. The stated fixing device includes: a heating rotary member; and a pressurizing rotary member that forms a nip by coming in contact with the heating rotary member. In this image forming apparatus, in a cross-section perpendicular to a rotation axis of the heating rotary member, (i) La is a straight line connecting an axial center of the heating rotary member and an axial center of the pressurizing rotary member, (ii) Lb is a line perpendicular to the straight line La, (iii) P is a point that is on an outline of a guiding surface of one of the pair of guiding members and that is closer to the pressurizing rotary member than any other points on the outline in a direction parallel to the straight line La, said one of the pair of guiding members being positioned closer to the heating rotary member than the other, (iv) Lc is one of two tangent lines passing through the point P and tangent to an outline of an outer circumference of the heating rotary member, whose point of tangency is closer to the nip than a point of tangency of the other, and (v) D is a distance between the point P and the straight line La. Also, in this image forming apparatus, (i) the distance D is larger than or equal to 1.6 times a diameter of the heating rotary member and is smaller than 2.4 times the diameter of the heating rotary member, and (ii) above the nip, the tangent line Lc leans further toward the heating rotary member than the perpendicular line Lb, and an angle formed by the tangent line Lc and the perpendicular line Lb is larger than or equal to 2.2° and is smaller than 6.5°.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 4 shows results of an experiment that was conducted to find out the occurrence of a curl and a wave by changing an angle α and a distance D, which indicate a relative positional relationship among an apex P on a guiding surface of a post-fixing guide near the heating roller, the heating roller, and the pressurizing roller;

Figure 5A:
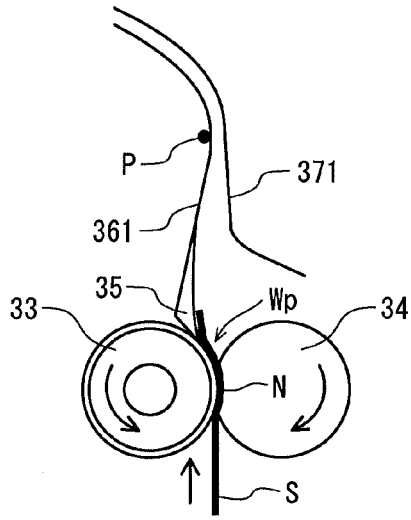
Figure 5B:
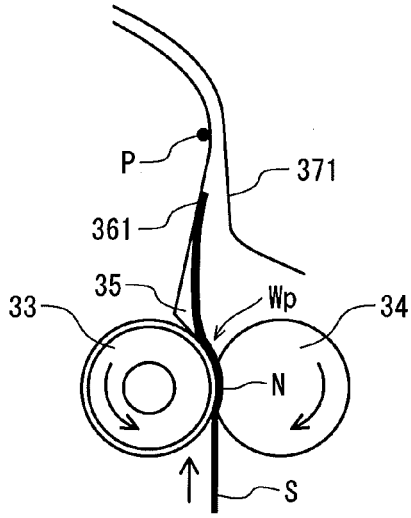
Figure 5C:
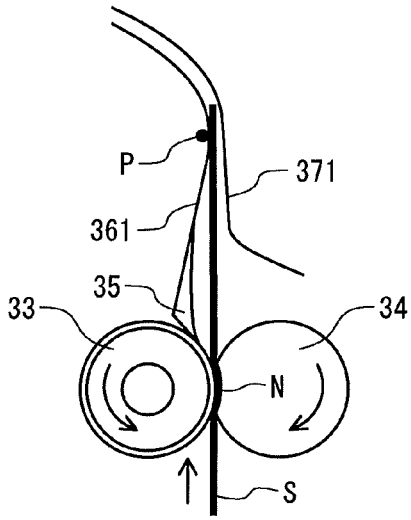
Figure 6A:
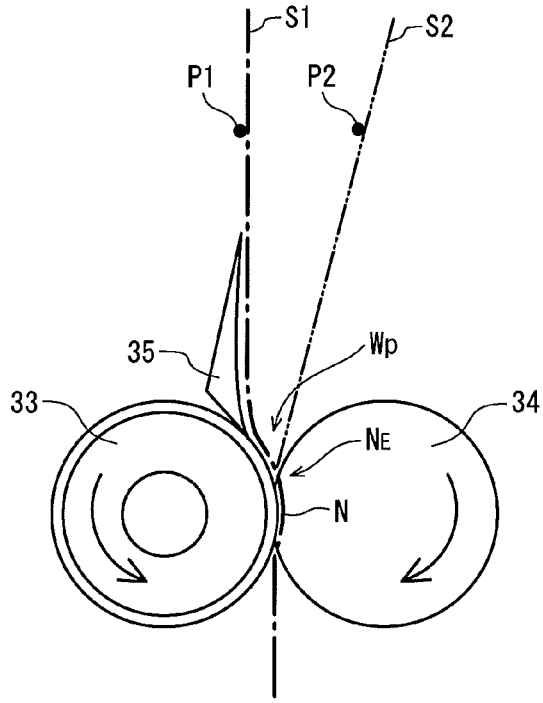
Figure 6B:
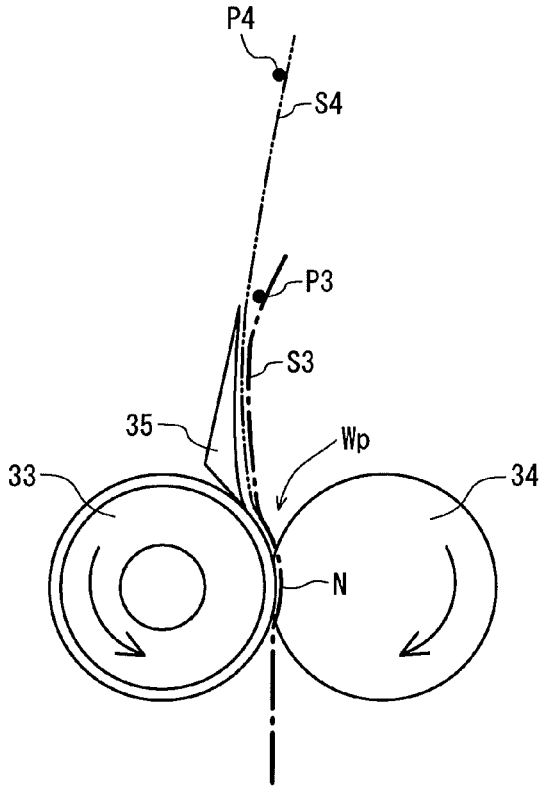
Figure 7:
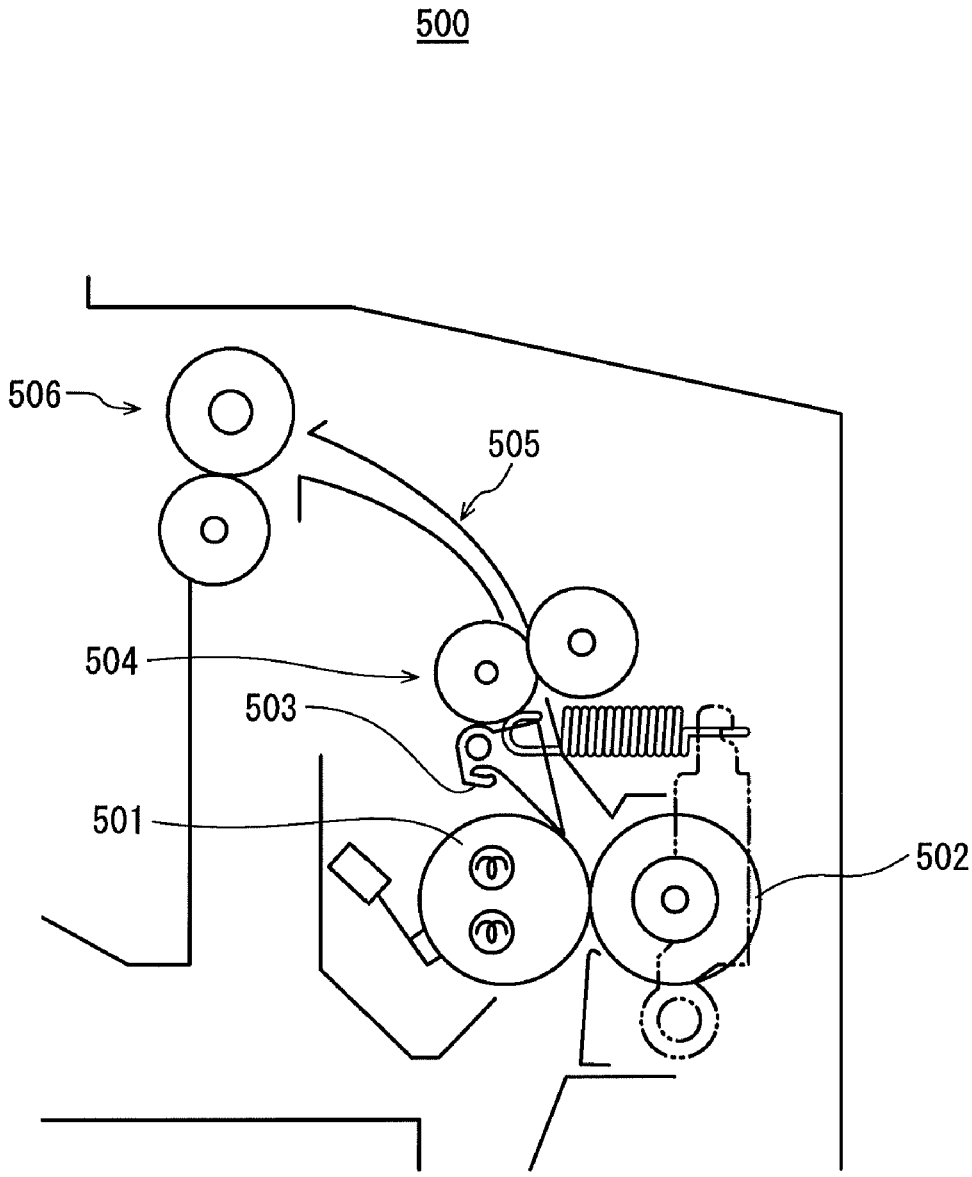

Each of FIGS. 5A, 5B and 5C is a schematic diagram illustrating how a leading edge of a recording sheet proceeds along a post-fixing guide 36 after passing through a fixing nip;

FIG. 6A is a schematic diagram showing trajectories along which the recording sheet is conveyed when the position of the apex P on the guiding surface of the post-fixing guide near the heating roller is moved horizontally toward the heating roller or the pressurizing roller from the most appropriate range;

FIG. 6B is a schematic diagram similarly showing trajectories along which the recording sheet is conveyed when the position of the apex P is made closer to and further distanced from the fixing nip N than the case of the most appropriate range; and FIG. 7 shows a curl suppression mechanism in a fixing device of a conventional image forming apparatus.

DESCRIPTION OF THE PREFERRED EMBODIMENT

The following describes an embodiment of a fixing device and an image forming apparatus comprising the fixing device, both of which pertain to the present invention, by taking an example of a monochrome printer (hereinafter simply referred to as a "printer").

(1) Overall Structure of Printer

Figure 1:
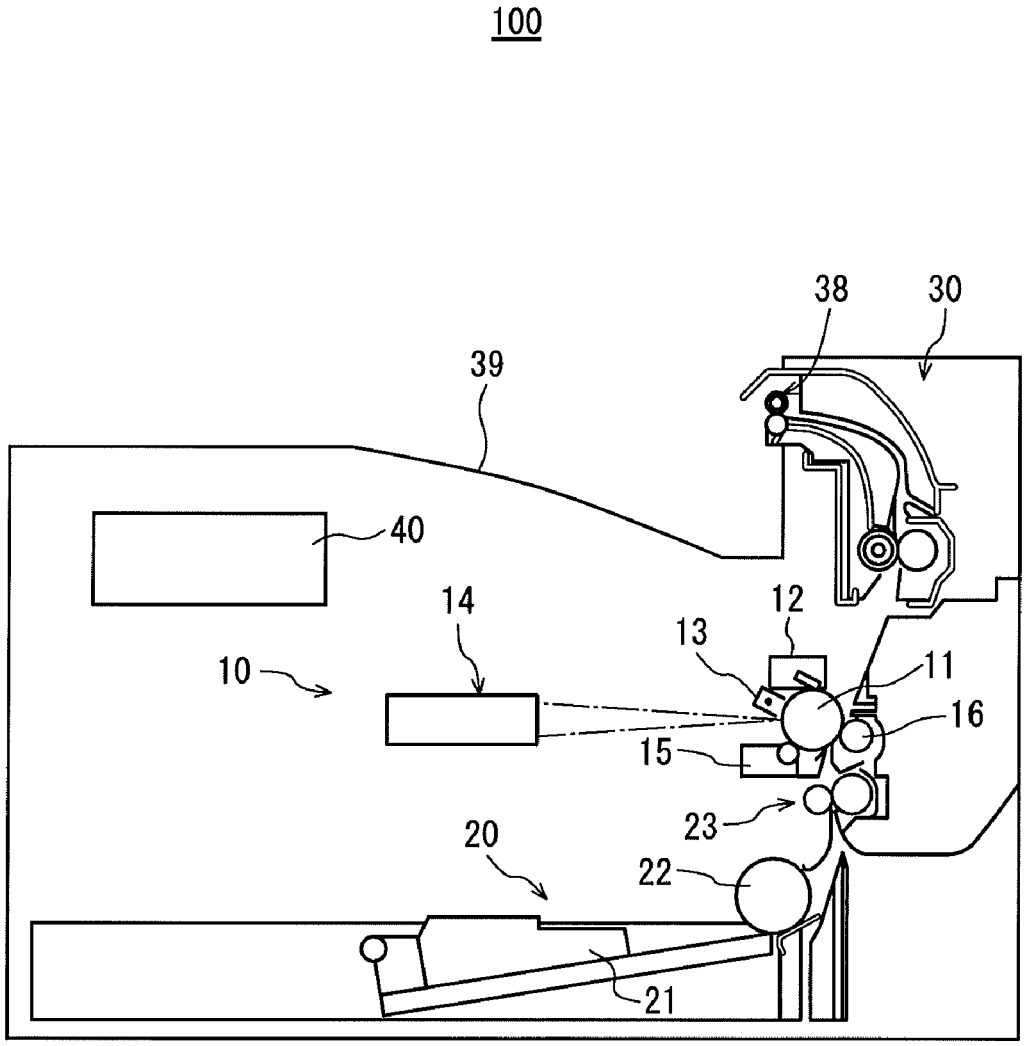
FIG. 1 is a diagram showing an embodiment of a printer pertaining to the present invention.

FIG. 1 is a schematic diagram showing the overall structure of a printer 100 pertaining to the present embodiment.

As shown in FIG. 1, the printer 100 forms an image by using electrophotography, and is composed of an image forming unit 10, a paper feeder 20, a fixing unit 30, and a controller 40.

The image forming unit 10 includes a photosensitive drum 11, a cleaner 12, a charger 13, an exposure scanning unit 14, a developer 15, a transfer roller 16, etc.

In the image forming unit 10, a circumferential surface of the photosensitive drum 11 is cleaned by the cleaner 12 to remove residual toner, and is thereafter uniformly charged by the charger 13. Then, the exposure scanning unit 14 performs exposure scanning of the circumferential surface of the photosensitive drum 11, thereby forming an electrostatic latent image on the circumferential surface of the photosensitive drum 11.

The electrostatic latent image formed on the photosensitive drum 11 is developed by receiving toner from the developer 15. As a result, a toner image is formed. Meanwhile, recording sheets (not illustrated) contained in a paper feed cassette 21 of the paper feeder 20 are picked up by a pickup roller 22, one by one. A recording sheet that has been picked up is conveyed to a transfer position (a position in which the photosensitive drum 11 and the transfer roller 16 are in contact with each other) by a timing roller 23 at an accurate timing, and the toner image formed on the photosensitive drum 11 is transferred to the recording sheet by the transfer roller 16.

The recording sheet, to which the toner image has been transferred, is conveyed to the fixing unit 30.

The toner image is fixed to the recording sheet by heat and pressure in the fixing unit 30. Subsequently, the recording sheet is discharged onto a discharge tray 39 via a discharge roller 38.

The controller 40 includes CPU as its central component, ROM, RAM, a communication interface, and the like. The controller 40 performs necessary processing on image data of a print job received from an external terminal via LAN, and realizes smooth execution of the print job by controlling the operations of the aforementioned image forming unit 10, paper feeder 20, etc.

(2) Structure of Fixing Unit 30

Figure 2:
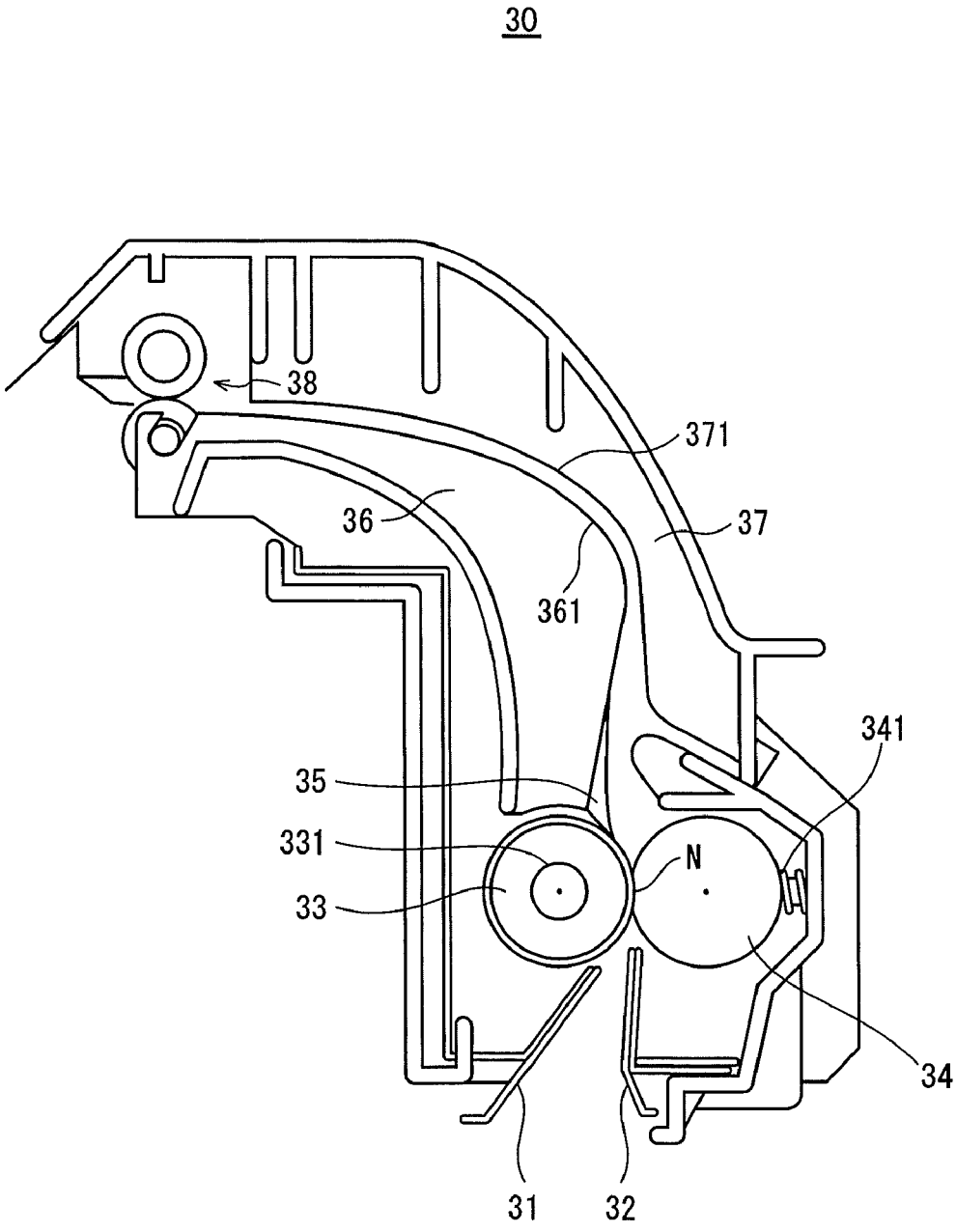
FIG. 2 is a cross-sectional view showing the structure of a fixing unit in the printer.

FIG. 2 shows the structure of the fixing unit 30 in a cross section perpendicular to a rotation axis of a heating roller 33.

The fixing unit 30 is composed of pre-fixing guides 31 and 32, the heating roller 33, a pressurizing roller 34, a separation claw 35, and post-fixing guides 36 and 37.

The heating roller 33 is a hollow metallic roller that accommodates therein a heat source 331 such as a halogen heater. A commonly-known releasing layer (not illustrated) is formed on an outer circumferential surface of the heating roller 33.

The controller 40 controls electric power supplied to the heat source 331 based on the output from a temperature sensor (not illustrated) that detects the temperature of the circumferential surface of the heating roller 33. This way, the heating roller 33 is kept at a temperature required to perform the fixing.

The pressurizing roller 34 is made by forming a thermostable elastic layer, such as a silicone rubber layer, around a circumference of a metallic shaft. A fixing nip N having a predetermined nip width is formed between the heating roller 33 and the pressurizing roller 34 by pushing a frame (not illustrated) of the pressurizing roller 34 toward the heating roller 33 using a compression spring 341, the frame axially supporting the pressurizing roller 34 at both axial ends of the pressurizing roller 34.

The pair of post-fixing guides 36 and 37 are positioned to face each other. Guiding surfaces 361 and 371 of the post-fixing guides 36 and 37 together form a conveyance path, through which a recording sheet that has passed through the fixing nip N is conveyed to the pair of discharge rollers 38. This conveyance path is curved so that the recording sheet proceeds upward first, and thereafter makes its way along a horizontal direction, leaning toward the post-fixing guide 36.

The distance between the guiding surfaces 361 and 371 is largest at an entrance of the conveyance path near the fixing nip N. This distance gradually decreases toward the downstream direction of the conveyance path, and eventually becomes substantially constant (approximately 3 mm) as the conveyance path extends to the proximity of the pair of discharge rollers 38.

The heating roller 33 and the pair of discharge rollers 38 are rotatably driven by a drive source (not illustrated) to convey the recording sheet at a predetermined speed.

In the fixing unit 30 having the above-described structure, once the recording sheet has passed through the transfer position, the recording sheet is directed to the fixing nip N by the pre-fixing guides 31 and 32. When the recording sheet passes through the fixing nip N formed between the heating roller 33 and the pressurizing roller 34, the toner image is fixed to the recording sheet by heat and pressure.

Afterwards, the recording sheet is directed by the post-fixing guides 36 and 37 to proceed toward the pair of discharge rollers 38 while curving horizontally toward the heating roller 33, and is discharged onto the discharge tray 39 via the pair of discharge rollers 38.

The feature of the present invention especially lies in the structure that can suppress a curl and a wave in the recording sheet immediately after the fixing is performed, due to the inventive shape of the above-mentioned post-fixing guide 36 and the inventive positional relationship among the post-fixing guide 36, the heating roller 33, and the pressurizing roller 34.

Figure 3:
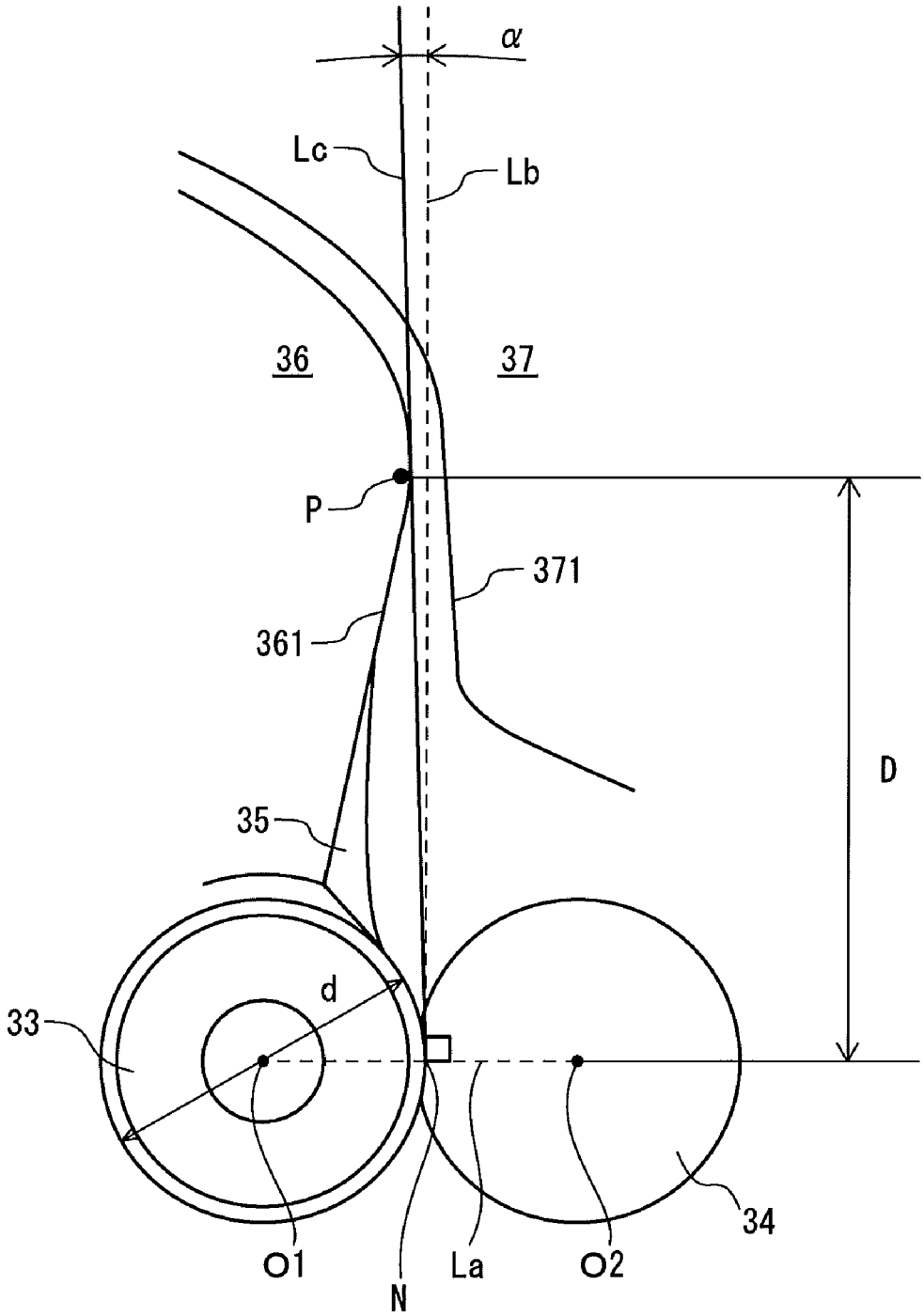
FIG. 3 shows the shapes of post-fixing guides and a positional relationship among the post-fixing guides, a heating roller, and a pressurizing roller in the fixing unit.

(3) Shapes of Post-Fixing Guides and Positional Relationship among Post-Fixing Guides, Heating Roller, and Pressurizing Roller FIG. 3 shows, out of the cross-sectional view of FIG. 2 showing the fixing unit 30, only the heating roller 33, the pressurizing roller 34, the separation claw 35, and the shapes of the guiding surfaces 361 and 371 of the post-fixing guides 36 and 37.

In FIG. 3, a straight line connecting axial centers O1 and O2 of the heating roller 33 and the pressurizing roller 34 is labeled La, whereas a line segment that is (i) perpendicular to the straight line La, and (ii) a tangent line that is tangent to the outer circumference of the heating roller 33 at the fixing nip N, is labeled Lb.

Each of the heating roller 33 and the pressurizing roller 34 is rotated in a predetermined direction (see FIGS. 5A to 5C). The heating roller 33 and the pressurizing roller 34 are positioned so as to convey the recording sheet from a lower side to an upper side in a vertical direction. In the present embodiment, the heating roller 33 and the pressurizing roller 34 are positioned so that the straight line La connecting the axes O1 and O2 is horizontal. However, as described in Description of the Related Art, the curl/wave problem occurs when causing the recording sheet to pass through the nip in the direction of the height of the printer 100 (this direction need not be an exact vertical direction). Thus, the straight line La is not necessarily required to be horizontal but may be slanted to an extent that is allowed in terms of design.

Also in FIG. 3, the guiding surface 361 forms a curved line (outline), and includes a curved portion that is convex toward the pressurizing roller 34 in a direction parallel to the straight line La. A point on the curved portion that is closest to the pressurizing roller 34 in the direction parallel to the straight line La—i.e., a point on the curved portion that is closest to the perpendicular line Lb in FIG. 3—is labeled P (apex P). A tangent line drawn from the apex P and tangent to the outer circumference of the heating roller 33 in proximity to the fixing nip N is labeled Lc. An angle formed by the tangent line Lc and the perpendicular line Lb is labeled $\alpha$.

Furthermore, a vertical distance between the apex P and the line segment La is labeled D, and a diameter of the heating roller 33 is labeled d.

With the above-described angle $\alpha$ and distance D considered as parameters, the conditions of a curl and a wave in the recording sheet discharged via the pair of discharge rollers 38 were observed while changing the parameters. Results of the experiment are shown in FIG. 4.

The experiment was conducted while switching between different atmospheres in an arbitrary manner. Each atmosphere had a temperature in a range of 10° C. to 30° C. and an absolute humidity in a range of 15% to 85%. The same experiment was repeatedly conducted in each atmosphere.

During the experiments, an A3 standard paper (with a basis weight of approximately 70 g/m$^2$) set in a crosswise direction was used as a recording sheet. When the output recording sheet placed on a flat surface partially curled off the flat surface by 30 mm or more, it was judged that the recording sheet was curled. Whether there was a wave (i.e., a repetition of minor curls) in the recording sheet was visually judged.

The printer used during the experiments comprised the heating roller 33 and the pressurizing roller 34 each having a diameter of 20 mm, and performed control to maintain a normal fixing temperature (approximately 175° C.).

As apparent from the results of experiments shown in FIG. 4, the following facts were found.

(a) When the Angle $\alpha$ is Smaller than 2.2°

Regardless of the magnitude of the distance D, the recording sheet was subjected to a back curl (i.e., the recording sheet was curled in such a manner that one surface on which an image was formed (the front side) was convex, and the other surface (the back side) was concave).

(b) When the Angle $\alpha$ is Larger than or Equal to 6.5°

Regardless of the magnitude of the distance D, the recording sheet was waved and subjected to a face curl (i.e., the recording sheet was curled in such a manner that one surface on which the image was formed (the front side) was concave).

(c) when the angle $\alpha$ is large than or equal to 2.2° and is smaller than 6.5°

(i) When the distance D is smaller than 1.6 times the diameter d of the heating roller 33 ($D<1.6d$), and when the distance D is larger than or equal to 2.4 times the diameter d of the heating roller 33 ($D\geqq 2.4d$), there was a wave in the recording sheet.

(ii) When the distance D is larger than or equal to 1.6 times the diameter d of the heating roller 33 and is smaller than 2.4 times the diameter d of the heating roller 33 ($1.6d\leqq D<2.4d$), none of a back curl, a face curl and a wave was found.

As described above, the magnitude of the distance D is defined in comparison to magnification of the diameter d of the heating roller 33 for the following reasons. As will be described later, a wave and a curl in the recording sheet are thought to result from a condition where, immediately after the fixing is performed, the recording sheet is wrapped around the circumferential surface of the heating roller 33 without getting released therefrom, and thus the curved shape of the circumferential surface of the heating roller 33 remains in the recording sheet. Also, there is a correlation between the length of a part of the recording sheet that is wrapped around the circumferential surface of the heating roller 33 and the diameter of the heating roller 33. That is to say, when the curvature of the circumferential surface of the heating roller 33 is large (i.e., when the diameter of the heating roller 33 is small), the length of the wrapped part of the recording sheet is short, because the recording sheet is released from the circumferential surface of the heating roller 33 (curvature-assisted release) immediately after passing through the fixing nip N due to its own firmness. On the other hand, when the curvature of the circumferential surface of the heating roller 33 is small (i.e., when the diameter of the heating roller 33 is large), the length of the wrapped part of the recording sheet is long, because the curvature-assisted release of the recording sheet is rarely achieved.

There is thought to be a correlation between a force required to release the recording sheet from the circumferential surface of the heating roller 33 and the length of the wrapped part of the recording sheet. The inventors of the present application focused on this point, and obtained the above-mentioned results of experiments shown in FIG. 4 by defining the magnitude of the distance D using the diameter d of the heating roller 33 as a parameter.

As can be seen from the above results of experiments, in an environment where the printer 100 is used, when the two conditions $2.2° \leqq \alpha < 6.5°$ and $1.6d \leqq D < 2.4d$ are satisfied, it is generally possible to effectively suppress a curl and a wave in a recording sheet (a standard paper) after the fixing is performed.

(4) Principle

As has been described above, the inventors focused on the distance D and the angle α. A curl and a wave in a recording sheet were prevented by defining the position of the apex P on the guiding surface 361 of the post-fixing guide 36 using the distance D and the angle α as parameters. This is thought to be because such a curl and a wave occur due to the following principle.

FIGS. 5A to 6B schematically show how a recording sheet S passes through the fixing nip N in the fixing unit 30 and then is directed by the post-fixing guides 36 and 37.

Referring to FIGS. 5A, 5B and 5C, after the recording sheet S has passed through the fixing nip N formed between the heating roller 33 and the pressurizing roller 34, the recording sheet S proceeds while being partially stuck to and wrapped around the circumferential surface of the heating roller 33, because of melted toner (the wrapped part is labeled Wp). A tip of the separation claw 35 is in a position where a leading edge of the recording sheet S is released from the circumferential surface of the heating roller 33 due to the firmness of the recording sheet S (curvature-assisted release). The recording sheet S is scooped by the separation claw 35 (FIG. 5A).

The recording sheet S proceeds while curving along the separation claw 35 and the guiding surfaces 361 (FIG. 5B). When the leading edge of the recording sheet S comes in proximity to the apex P on the guiding surface 361, the recording sheet S, due to its own firmness, is released from a part of the circumferential surface of the heating roller 33 corresponding to the wrapped part Wp, a surface of the separation claw 35, and a surface of a part of the guiding surface 361 extending from the separation claw 35 to the apex P (FIG. 5C).

A curl and a wave in the recording sheet S are thought to occur because, when the moisture evaporated primarily due to the heating of the heating roller 33 is absorbed back into the recording sheet S, the shape of the recording S at that moment tends to be fixed. Referring to FIG. 5C, immediately after the fixing is performed, the recording sheet S is corrected in posture by the effect of the apex P so that the recording sheet S has a substantially straight posture. This is presumably the reason why such phenomena as a curl and a wave—repetitive curls remaining in the recording sheet S due to the recording sheet S being wrapped around the heating roller 33—are unlikely to occur in the recording sheet S.

However, if the angle α is above the most appropriate range described earlier ($\alpha \geqq 6.5°$), i.e., if the apex P on the guiding surface 361 is in a position P1 shown in FIG. 6A that is horizontally closer to the heating roller 33 than the apex P shown in FIGS. 5A through 5C, then the firmness of the recording sheet cannot prevent the recording sheet from being wrapped around the heating roller 33, and the recording sheet proceeds along a one-dot chain line 51 shown in FIG. 6A. As a result, the curved shape of the wrapped part Wp of the recording sheet remains, causing a wave and a face curl in the recording sheet. This may lower the quality of output and cause the recording sheet to be curled up on the discharge tray 39. If that happens, a leading edge of the subsequently following recording sheet could hit the curled up recording sheet on the discharge tray 39, which may deter a smooth paper discharge and cause a jam.

Conversely, if the angle α is below the most appropriate range described earlier ($\alpha < 2.2°$, including the case of $\alpha < 0$ where the tangent line Lc leans toward the right side of the perpendicular line Lb), i.e., if the apex P on the guiding surface 361 is in a position P2 shown in FIG. 6A that is horizontally closer to the pressurizing roller 34 than the apex P shown in FIGS. 5A through 5C, then the recording sheet can be released with use of the separation claw 35 due to its own firmness. In this case, however, the recording sheet bends rightward (toward the pressurizing roller 34) at the fixing nip N at a large angle, and the recording sheet proceeds along a two-dot chain line S2. As a result, a curl tends to be formed and remain on the recording sheet at a downstream edge NE of the fixing nip N in a direction of conveyance of the recording sheet. This is presumably the reason why the back curl is caused.

When the back curl occurs, a corner of the recording sheet is likely to bend (a bent corner) halfway through the conveyance path before the recording sheet reaches the pair of discharge rollers 38. This lowers the conveyance performance. Furthermore, when the back curl occurs, the recording sheet may be curled up on the discharge tray 39 such that its front side is convex. If that happens, a leading edge of the subsequently following recording sheet may hit the curled up recording sheet on the discharge tray 39, causing a jam.

Meanwhile, assume a case where the apex P is in a position P3 shown in FIG. 6B that is close to the fixing nip N compared to the case of the most appropriate range ($D < 1.6d$). In this case, when the recording sheet reaches P3, the recording sheet just got heated and is therefore very soft. It is therefore thought that a wave remains in the recording sheet because at this moment, the firmness of the recording sheet is not enough to prevent the recording sheet from being wrapped around the heating roller 33.

Conversely, assume a case where the apex P is in a position P4 shown in FIG. 6B that is further distanced from the fixing nip N compared to the case of the most appropriate range ($D \geqq 2.4d$). In this case, the distance between the position P4 and the fixing nip N is so long that the recording sheet becomes slack. Even though the apex P is intended to push the recording sheet back to the right, this effect does not reach the vicinity of the fixing nip N. It is therefore thought that a wave remains in the recording sheet because the recording sheet cannot be prevented from being wrapped around the heating roller 33.

As set forth above, the inventors of the present application have discovered that a curl and a wave remaining in the recording sheet immediately after the fixing is performed are significantly influenced by the position of the apex P on the post-fixing guide 36. The inventors of the present application focused on this point and repeatedly conducted the experiments while setting the angle α and the distance D as parameters as shown in FIG. 4. As a result, they could obtain the most appropriate ranges for these parameters.

In the present embodiment, there is no need to provide intermediate rollers 504 between the fixing nip N and the pair of discharge rollers 38 as required conventionally. By simply modifying the shapes of conventional post-fixing guides to satisfy the most appropriate conditions shown in FIG. 4, the present embodiment can effectively suppress a curl and a wave in the recording sheet while maintaining a low cost.

<Modification Examples>

The present invention has been described based on the above embodiment. However, it goes without saying that the contents of the present invention are not limited to the above embodiment. For example, the following modification examples are possible.

(1) The present invention has been described on the precondition that it prevents a wave and a curl caused by, for example, the recording sheet being wrapped around the heating roller 33. Therefore, the present invention is not applicable to a case where the surface of the heating roller 33 is softer than that of the pressurizing roller 34 and a predetermined nip width is formed due to deformation of the heating roller 33. This is because, in such a case, the curvature of the heating roller 33 is significantly large at an edge of the nip width, and the recording sheet that has passed through the fixing nip N is released from the surface of the heating roller 33 due to its own firmness (curvature-assisted release) without getting wrapped around the heating roller 33.

In the above embodiment, a hollow metallic roller is used for the pressurizing roller 34 because the pressurizing roller 34 accommodates therein a halogen heater as its heat source. However, an outer layer portion of the body of the heating roller 33 need not be made of metal, for example, in the following cases: (i) a case where a resistance heating layer is formed on the circumferential surface of the heating roller 33, and the heating roller 33 is heated by supplying electric power to both axial ends of the resistance heating layer; and (ii) a case where a heating layer made of a thin metallic material is formed on the circumferential surface of the heating roller 33, and the heating roller 33 is heated by electromagnetic induction while causing an external excitation coil to generate the alternating magnetic field. The present invention is applicable as long as the heating roller 33 is made of a material that is harder than the material of the pressurizing roller 34 and there is a possibility that the recording sheet may be wrapped around the heating roller 33.

(2) Furthermore, the above-described heating roller 33 and pressurizing roller 34 are not the only examples to be used as a heating rotary member and a pressurizing rotary member of a fixing device to which the present invention is applied, respectively.

For example, if the fixing device is structured such that a fixing belt is suspended by two supporting rollers and a fixing nip is formed by pressing a pressurizing roller toward one of the supporting rollers via the fixing belt, there is a possibility that the recording sheet is wrapped around a part of the fixing belt that is on the stated one of the supporting rollers at a downstream portion of the fixing nip in a direction of conveyance of the recording sheet. At this part of the fixing belt, the conditions similar to those described in the above embodiment could occur.

In this case, an axial center of the stated one of the supporting rollers that faces the pressurizing roller is the equivalent of the axial center of the above-described heating roller 33, whereas a value obtained by adding the diameter of the stated one of the supporting rollers and the thickness of the fixing belt is the equivalent of the diameter d of the heating roller 33.

(3) The above embodiment has described a monochrome printer as one example of an image forming apparatus pertaining to the present invention. However, the present invention is not limited to a specific type of printer, as long as it is an image forming apparatus that performs thermal fixing while conveying a recording sheet in the direction of the height of the apparatus. An image forming apparatus pertaining to the present invention may be a full-color printer, a copier or a facsimile device comprising such a printer, and a multifunction peripheral.

The present embodiment may be any possible combination of the above embodiment and modification examples.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device comprising:

a heating rotary member;

a pressurizing rotary member that forms a nip by coming in contact with the heating rotary member; and a pair of guiding members for guiding a recording sheet, which has been conveyed with a toner image formed on a surface thereof and which has passed through the nip, toward a direction along which the recording sheet is discharged, wherein in a cross-section perpendicular to a rotation axis of the heating rotary member, (i) La is a straight line connecting an axial center of the heating rotary member and an axial center of the pressurizing rotary member, (ii) Lb is a line perpendicular to the straight line La, (iii) P is a point that is on an outline of a guiding surface of one of the pair of guiding members and that is closer to the pressurizing rotary member than any other points on the outline in a direction parallel to the straight line La, said one of the pair of guiding members being positioned closer to the heating rotary member than the other, (iv) Lc is one of two tangent lines passing through the point P and tangent to an outline of an outer circumference of the heating rotary member, whose point of tangency is closer to the nip than a point of tangency of the other, and (v) D is a distance between the point P and the straight line La, the distance D is larger than or equal to 1.6 times a diameter of the heating rotary member and is smaller than 2.4 times the diameter of the heating rotary member, and downstream of the nip in a direction of conveyance of the recording sheet, the tangent line Lc leans further toward the heating rotary member than the perpendicular line Lb, and an angle formed by the tangent line Lc and the perpendicular line Lb is larger than or equal to 2.2° and is smaller than 6.5°.

2. The fixing device of claim 1, wherein the heating rotary member and the pressurizing rotary member are positioned so as to, while being rotated and holding the recording sheet therebetween at the nip, convey the recording sheet from a lower side to an upper side in a vertical direction.

3. The fixing device of claim 2, wherein the pair of guiding members forms a path therebetween through which the recording sheet is guided, the path being curved such that the recording sheet that has passed through the nip heads to the upper side in the vertical direction and thereafter proceeds in a horizontal direction.

4. The fixing device of claim 1, wherein a distance between the pair of guiding members is largest at an entrance of the path near the nip, and the distance between the pair of guiding members gradually decreases from the entrance of the path toward a downstream direction of the path and thereafter becomes substantially constant.

5. The fixing device of claim 1, wherein the pressurizing rotary member includes an elastic layer at a circumferential surface thereof and is softer than the heating rotary member.

6. An image forming apparatus comprising:

a toner image forming unit configured to form a toner image on a recording sheet;

a fixing device configured to fix the toner image on the recording sheet; and a pair of guiding members for guiding the recording sheet which has passed through the fixing device and on which the toner image has been fixed, toward a direction along which the recording sheet is discharged, wherein the fixing device includes:

a heating rotary member; and a pressurizing rotary member that forms a nip by coming in contact with the heating rotary member, in a cross-section perpendicular to a rotation axis of the heating rotary member, (i) La is a straight line connecting an axial center of the heating rotary member and an axial center of the pressurizing rotary member, (ii) Lb is a line perpendicular to the straight line La, (iii) P is a point that is on an outline of a guiding surface of one of the pair of guiding members and that is closer to the pressurizing rotary member than any other points on the outline in a direction parallel to the straight line La, said one of the pair of guiding members being positioned closer to the heating rotary member than the other, (iv) Lc is one of two tangent lines passing through the point P and tangent to an outline of an outer circumference of the heating rotary member, whose point of tangency is closer to the nip than a point of tangency of the other, and (v) D is a distance between the point P and the straight line La, the distance D is larger than or equal to 1.6 times a diameter of the heating rotary member and is smaller than 2.4 times the diameter of the heating rotary member, and downstream of the nip in a direction of conveyance of the recording sheet, the tangent line Lc leans further toward the heating rotary member than the perpendicular line Lb, and an angle formed by the tangent line Lc and the perpendicular line Lb is larger than or equal to 2.2° and is smaller than 6.5°.

7. The image forming apparatus of claim 6, wherein the heating rotary member and the pressurizing rotary member are positioned so as to, while being rotated and holding the recording sheet therebetween at the nip, convey the recording sheet from a lower side to an upper side in a vertical direction.

8. The image forming apparatus of claim 7, wherein the pair of guiding members forms a path therebetween through which the recording sheet is guided, the path being curved such that the recording sheet that has passed through the nip heads to the upper side in the vertical direction and thereafter proceeds in a horizontal direction.

9. The image forming apparatus of claim 6, wherein a distance between the pair of guiding members is largest at an entrance of the path near the nip, and the distance between the pair of guiding members gradually decreases from the entrance of the path toward a downstream direction of the path and thereafter becomes substantially constant.

10. The image forming apparatus of claim 6, wherein the pressurizing rotary member includes an elastic layer at a circumferential surface thereof and is softer than the heating rotary member.

* * * * *